US008347781B2

(12) United States Patent
Stack

(10) Patent No.: US 8,347,781 B2
(45) Date of Patent: Jan. 8, 2013

(54) PORTABLE FOOD COOLING DEVICE

(76) Inventor: William Joseph Stack, East Windsor, NJ (US)

( * ) Notice: Subject to any disclaimer, the term of this patent is extended or adjusted under 35 U.S.C. 154(b) by 879 days.

(21) Appl. No.: 11/906,788

(22) Filed: Oct. 4, 2007

(65) Prior Publication Data

US 2009/0090251 A1 Apr. 9, 2009

(51) Int. Cl.
*A23N 1/00* (2006.01)
*A23G 1/10* (2006.01)

(52) U.S. Cl. ..... 99/496; 99/485; 99/495; 62/3.6; 62/457.3; 62/457.4; 220/203.01; 220/203.02; 454/188; 454/193

(58) Field of Classification Search ..... 99/496; 62/3.6, 457.3, 457.4; 220/203.01–203.09
See application file for complete search history.

(56) References Cited

U.S. PATENT DOCUMENTS 2,241,853 A * 5/1941 Hall et al. ..... 62/62
2,915,884 A * 12/1959 Haushalter et al. ..... 62/256
3,710,589 A * 1/1973 Brown et al. ..... 62/457.2
3,988,902 A * 11/1976 Jacobs ..... 62/136
4,019,339 A * 4/1977 Anderson ..... 62/255
4,722,200 A * 2/1988 Frohbieter ..... 62/382
4,788,905 A * 12/1988 Von Kohorn ..... 99/357
4,817,509 A * 4/1989 Erickson ..... 99/330
4,823,554 A * 4/1989 Trachtenberg et al. ..... 62/3.3
4,852,359 A * 8/1989 Manzotti ..... 62/68
5,000,085 A * 3/1991 Archer ..... 99/445
5,062,281 A * 11/1991 Oliphant et al. ..... 62/457.1
5,183,998 A * 2/1993 Hoffman et al. ..... 219/492
5,282,367 A * 2/1994 Moore et al. ..... 62/256
5,423,194 A * 6/1995 Senecal ..... 62/457.6
5,718,124 A * 2/1998 Senecal ..... 62/457.6
5,738,786 A * 4/1998 Winnington-Ingram ..... 210/474
5,782,094 A * 7/1998 Freeman ..... 62/3.6
5,789,007 A * 8/1998 Bianco ..... 426/263
6,076,363 A * 6/2000 Morton ..... 62/89
6,094,931 A * 8/2000 Jeong ..... 62/407
6,295,820 B1 * 10/2001 Cauchy et al. ..... 62/3.6
6,539,741 B2 * 4/2003 Navarro ..... 62/256
6,571,568 B1 * 6/2003 Link ..... 62/244
6,651,445 B1 * 11/2003 Clark et al. ..... 62/3.6
6,698,420 B2 * 3/2004 Anthony ..... 126/381.1
6,732,534 B2 * 5/2004 Spry ..... 62/3.7
6,763,665 B2 * 7/2004 Clark et al. ..... 62/3.6
6,799,433 B1 * 10/2004 Gleason et al. ..... 62/457.9
6,976,371 B2 * 12/2005 Gleason et al. ..... 62/457.9
7,082,773 B2 * 8/2006 Cauchy ..... 62/3.3
7,174,822 B2 * 2/2007 Friel, Sr. ..... 83/707
7,308,796 B1 * 12/2007 Eager ..... 62/3.2
2002/0040711 A1 * 4/2002 Anthony ..... 126/381.1
2005/0011218 A1 * 1/2005 Pearson et al. ..... 62/407
2005/0022549 A1 * 2/2005 Anderson et al. ..... 62/317
2006/0070396 A1 * 4/2006 Glover ..... 62/420

* cited by examiner

*Primary Examiner* — Tu B Hoang
*Assistant Examiner* — Brett Spurlock
(74) *Attorney, Agent, or Firm* — Gary P. Topolosky; Glenn E. Klepac

(57) ABSTRACT

A food cooling device includes a cover, an electric motor powering a fan, and an automatic switch. The cover defines air intake openings beneath a motor housing, a bottom orifice, and vents between the air intake openings and the orifice. The bottom opening rests on a table, covering a plate containing hot food. A fan blade directs air toward the food, the air cools the food, and the heated air escapes through the vents. The cooling device is portable, light in weight, and easy to operate, making it suitable for use by small children as well as handicapped persons of all ages.

12 Claims, 2 Drawing Sheets

PORTABLE FOOD COOLING DEVICE

FIELD OF THE INVENTION

The present invention relates to a food cooling device suitable for use by children and handicapped adults.

BACKGROUND OF THE INVENTION

Hot food served to children at home and in restaurants is often so hot that it burns their mouths or lips. Young children usually are unable to cool hot foods themselves. Accordingly there is a need for a portable cooling device that may be used anywhere, for cooling hot foods without contaminating or noticeably dehydrating them. Both children and handicapped or elderly adults may benefit from having access to such portable device at meal time.

Various containers for cooling and heating food and beverages are known in the prior art. Some prior art patents disclosing food coolers are Bullard U.S. Pat. No. 4,468,932; Carmi U.S. Pat. No. 5,060,479; Oliphant U.S. Pat. No. 5,062,281; Freeman U.S. Pat. No. 5,782,094; Cheng U.S. Pat. No. 5,953,933; and Clark U.S. Pat. No. 6,763,665. Devices shown in these prior art patents are larger and more expensive than the portable food cooler of the present invention. Accordingly there still remains a need for a food cooling device that is simple enough to be used by both children as well as handicapped adults, inexpensive, portable, and durable.

OBJECTIVES AND ADVANTAGES

A principal objective of the present invention is to provide a portable device for cooling hot foods so that they may be safely eaten by children without burning the insides of their mouths or their lips or fingers.

A related objective of the invention is to provide a portable device for cooling hot food without contaminating it.

The cooling device of the invention benefits from being portable, inexpensive, durable, easy to use, and adjustable in speed according to the type of food being cooled.

Additional objectives and advantages of my invention will become apparent to persons skilled in the art from the detailed description that follows, considered along with the drawings.

SUMMARY OF THE INVENTION

In accordance with the present invention there is provided a device and a process for cooling food. The food cooling device includes a cover comprising a dome-shaped plastic body covering an enclosed space. The body defines a bottom opening sized to fit laterally exterior to a dish holding hot food. As used herein the term "dish" refers to various vessels of different shapes that are used for holding hot food. The term "dish" includes plates, saucers, and bowls made from ceramic, glass, plastic, metal, or composite materials. The bottom opening of the cover is preferably circular. The plastic body also defines a plurality of vents for releasing vapors emanating from the food.

The cooling device also includes a motor compartment spaced upwardly from the bottom opening. The motor compartment contains an electric motor, a battery powering the motor, and a switch. The electric motor includes a shaft preferably extending downwardly below the cover. The shaft is connected with a fan blade. The fan blade may be metal or plastic and is preferably made from a washable plastic material. Rotating the fan blade draws outside air into the motor compartment, then into the closed space through air intake openings in the cover, downwardly towards the hot food, and finally laterally outwardly through the vents. The fan cools hot food quickly, generally faster than merely blowing on the food or fanning it.

The electric motor is preferably a variable speed motor. The motor may have a high speed and a low speed or it may have a continuous range of speeds between a highest speed and an off position. The highest speed is used for cooling solid foods and speeds in the lower portion of the range are useful for cooling hot liquids such as soup and hot beverages.

The motor compartment is preferably covered by a plastic housing. The housing is situated exterior to the device, preferably concealing the air intake openings.

The switch is preferably an automatic switch for turning the motor on and off. The automatic switch is sensitive to changes in position of the motor compartment relative to the bottom opening. The automatic switch contains a swinging magnet and is sensitive to changes in position of the food cooling device. The switch may also be manually controlled.

The cover preferably comprises polystyrene and more preferably foamed polystyrene. An exterior surface of the body may display printed indicia such as cartoon characters, thereby making the device visually more attractive to young children.

DETAILED DESCRIPTION OF A PREFERRED EMBODIMENT

Figure 1:
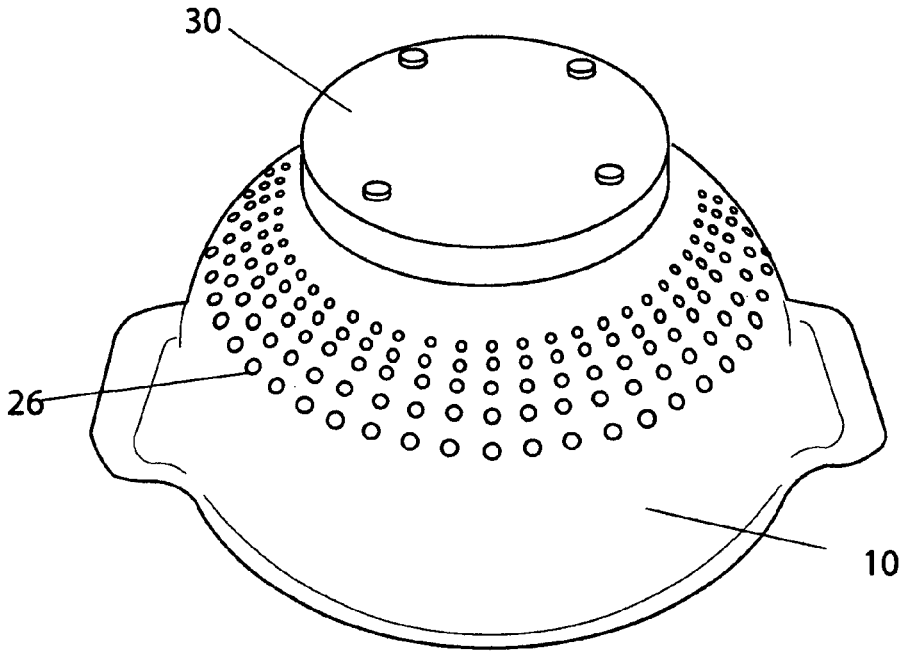
FIG. 1 is a perspective view of a preferred food cooling device of the invention.
Figure 2:
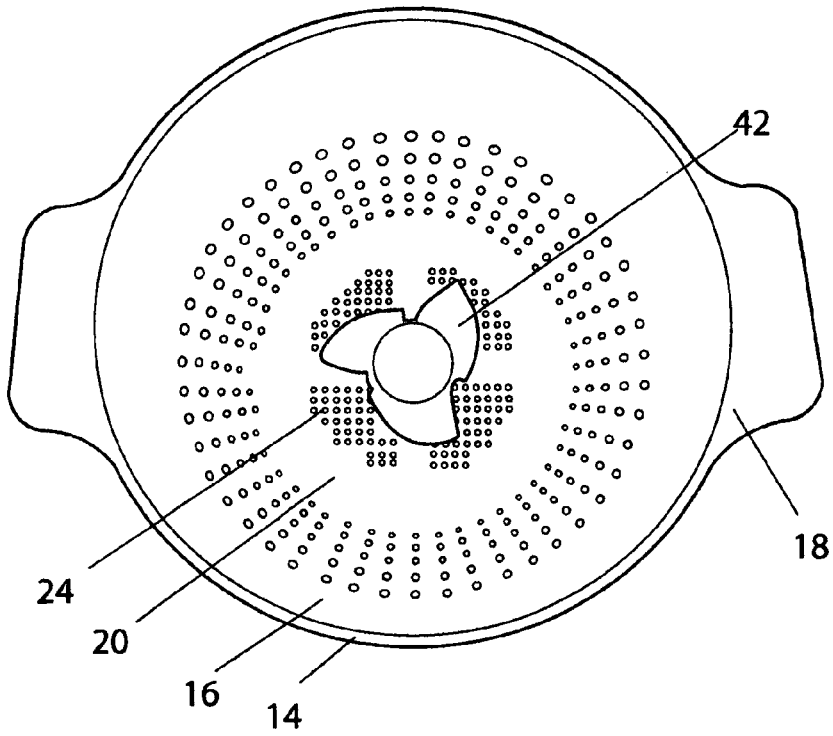
FIG. 2 is a bottom plan view of the food cooling device of FIG. 1.

A particularly preferred food cooling device 10 is shown in FIGS. 1 and 2. The device 10 includes a cover 12 having a body 14 defining a bottom opening or orifice 16. Two flanges or handles 18 extend laterally outward of the body 14, near the bottom opening 16. The body 14 also includes a top or top wall 20 and a side wall 22 extending between the top wall 20 and the bottom orifice 16.

The top wall 20 defines several air intake openings 24. The side wall 22 is formed with vents 26 at spaced intervals around the circumference thereof. A rim 28 of the top wall 20 is formed with external screw threads 29.

A motor housing 30 above the top wall 20 has internal screw threads 31 mating with the external screw threads 29. The motor housing 30 covers a compartment 32 containing an electric motor 34, batteries 36, and a switch 38. The motor 34 rotates a fan shaft 40 extending downwardly of the top wall 20. The fan shaft 40 supports 3 fan blades 42 extending radially outwardly of the shaft 40. The switch 38 is preferably a gravity sensitive switch including a magnet and operating automatically in response to changes in position of the device 10. The switch 38 is also actuated manually by finger pressure. The motor 34 is preferably a variable speed electric motor operated at 3 volts, powered by 2 AA batteries 36.

Figure 3:
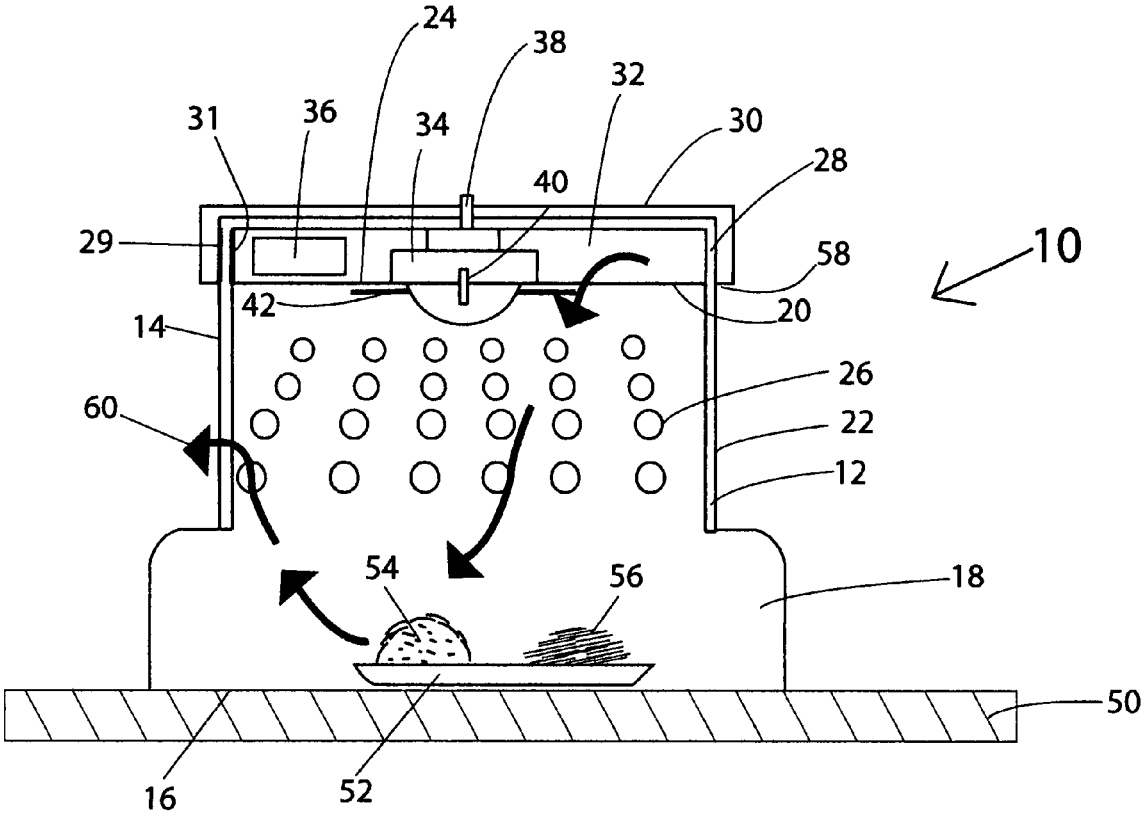
FIG. 3 is a schematic, side, cross-sectional view of the cooling device of FIG. 1.

Referring now to FIG. 3, the cooling device 10 is shown with its flanges 18 resting on top of a table or other substrate 50. The device 10 has its bottom orifice 16 situated radially outward of a plate 52 holding heated mashed potatoes 54 and meat pieces 56 such as beef or poultry slices.

The switch 38 turns on the motor 34, drawing outside air through a slot or space 58 between the housing 30 and body

14. The fan blades 42 then draw the air downwardly through the air intake openings 24 and underneath the cover 10 towards the food 54, 56. After cooling the food 54, 56, the heated air passes outwardly and upwardly, exiting through the vents 26. In FIG. 3, air flows in the general direction of the arrows 60 shown in several locations. The motor 34 is preferably a variable speed motor, enabling rotation of the fan blades at a lower speed for soup and other hot liquids than for the solid foods 54, 56 shown in FIG. 3. The lower operating speed prevents spillage of hot liquids onto the table 50.

The foregoing detailed description of my invention has been made with respect to a particularly preferred embodiment. Persons skilled in the art understand that numerous changes and modifications can be made in my food cooling device and process without departing from the spirit and scope of the following claims.

What is claimed is:

1. A portable device for cooling hot food served on a dish so as to quickly render the served hot food sufficiently cool to be safely eaten without burning a person's mouth, lips or fingers, in combination with the dish of hot food, said portable device comprising:

(a) a cover comprising a generally dome-shaped plastic body defining a bottom opening circumscribing said dish and sized to fit laterally exteriorly over the dish but not contacting with said hot food, said body having a plurality of vents extending laterally through the plastic body between an upper location of the cover and said bottom opening through which vapors emanating from the hot food on the dish will be released outside said plastic body, (b) a motor compartment spaced upwardly of said bottom opening located at said upper location of the cover, said compartment containing an electric motor, at least one battery for powering the motor to rotate a fan shaft connected with the motor, a gravity sensitive switch including a magnet and operating automatically in response to changes in position of the portable device for turning the motor on and off wherein the motor is on when the portable device is upside-down an off when the portable device is right-side up, and (c) at least one fan blade extending from the fan shaft, said fan blade being spaced upwardly of said bottom opening.

2. The portable food cooling device of claim 1 wherein said switch is an automatic switch stopping the motor when the bottom opening is positioned so that the motor compartment is downward of the bottom opening.

3. The portable food cooling device of claim 1 wherein said switch is manually controlled.

4. The portable food cooling device of claim 1 wherein said plastic body comprises polystyrene foam.

5. The portable food cooling device of claim 1 wherein said plastic body includes an exterior surface decorated with printed indicia.

6. The portable food cooling device of claim 5 wherein said printed indicia include cartoon characters.

7. The portable food cooling device of claim 1 further comprising at least one handle extending laterally outwardly of said plastic body, adjacent said bottom opening.

8. The portable food cooling device of claim 1 wherein said fan blade comprises a washable plastic material.

9. The portable food cooling device of claim 1 wherein said bottom opening is circular.

10. The portable food cooling device of claim 1 wherein said motor compartment is covered by a housing and said plastic body defines a plurality of air intake openings between said housing and said vents, said housing being located exteriorly of the air intake openings.

11. A process for cooling heated food served on a dish to render the heated food sufficiently cool so as to be more safely eaten without burning a person's mouth, lips or fingers, said process comprising:

(a) covering the dish of heated food with a food cooling device that will not contact the heated food on the dish, said food cooling device comprising a cover defining a bottom opening circumscribing said dish, said food cooling device including an electric fan powered by a battery operated electric motor, said fan having at least one fan blade spaced downwardly of said motor, said motor being located in a compartment spaced upwardly of said dish, said compartment being covered by a housing, said cover defining a plurality of air intake openings concealed by said housing when the cover is positioned above said dish, said cover also defining a plurality of vents between the housing and the bottom opening of the cover, (b) cooling said food by rotating said blade to draw air into the compartment, drawing said air inwardly through the air intake openings toward the food, and then conducting said air away from said food, outwardly through the vents and outside said cover, and (c) lifting said cover from said dish to reveal the cooled food whereby the electric fan includes a gravity sensitive switch including a magnet and operating automatically in response to changes in position of the portable device for turning the electric fan on and off wherein the electric fan is on when the portable device is upside-down an off when the portable device is right-side up.

12. The process of claim 11 wherein said compartment contains an automatic switch for turning said motor on and off, said process further comprising:

(d) automatically switching said motor on when the compartment is positioned above the bottom opening and automatically switching said motor off when the compartment is positioned below the bottom opening.

* * * * *